United States Patent [19]

Russell

[11] Patent Number: 4,848,712

[45] Date of Patent: Jul. 18, 1989

[54] FOLDING UNIPOD SEAT

[75] Inventor: Richard L. Russell, Ottawa Lake, Mich.

[73] Assignee: Tongue Lock, Inc., Toledo, Ohio

[21] Appl. No.: 161,183

[22] Filed: Feb. 26, 1988

[51] Int. Cl.[4] ..... A45D 19/04

[52] U.S. Cl. ..... 248/155.2; 248/435; 297/183; 297/331

[58] Field of Search ..... 248/435, 155, 155.1, 248/155.2, 155.4, 156; 108/115, 50, 150; 297/118, 183, 331, 4; 135/66

[56] References Cited

U.S. PATENT DOCUMENTS

| | | | |
|---|---|---|---|
| 1,456,304 | 5/1923 | Fritschka | 135/66 |
| 2,800,164 | 7/1957 | Chambers | 248/155.1 |
| 3,058,711 | 10/1962 | Kingsford | 248/156 X |
| 4,098,478 | 7/1978 | Spitzke | 108/115 X |

FOREIGN PATENT DOCUMENTS

| | | | |
|---|---|---|---|
| 850535 | 12/1939 | France | 248/156 |
| 25743 | of 1910 | United Kingdom | 248/155.2 |
| 411513 | 6/1934 | United Kingdom | 248/155.2 |
| 473751 | 10/1937 | United Kingdom | 248/155.1 |

*Primary Examiner*—J. Franklin Foss

*Attorney, Agent, or Firm*—Emch, Schaffer, Schaub & Porcello Co.

[57] ABSTRACT

A unipod seat with a support rod having a first end and a second end. The first end of the support rod having converging sidewalls and terminating in a point. A support bracket is rotatably mounted on the support rod. A support arm is pivotally mounted on each side of the support bracket. The support arms have a support position and a folded position. A means for locking the support arms in the support position and the locking means being mounted on the support bracket. A flexible material connected to the support arms. The flexible material forming a seat when the support arms are in the support position.

10 Claims, 3 Drawing Sheets

FOLDING UNIPOD SEAT

BACKGROUND OF THE INVENTION

This invention relates to a unipod or portable seat. More particularly, the invention relates to a portable folding seat of the type frequently used by spectators at sporting events.

Portable seat have been around for many years but have had limited degrees of acceptability due to the generally high cost and uncomfortable seating provided by such seats. On the previous seats only a sling type seat is provided. When the user sits on the seat the weight of the user causes the center of the seat to sag and causes the seat to generally press against the sides of the user. After relatively short periods of time this type of seat becomes very uncomfortable and may even reduce the circulation in the lower extremities of the user. These disadvantages certainly limited the acceptability of portable seats and have also greatly reduced how long a user can comfortably be seated on such a seat.

Accordingly, it is an object of the present invention to provide an improved portable seat that is more comfortable to use.

It is a further object of the invention to provide a portable seat where the seat portion does not sag or collapse and press against the sides of the user.

It is a further object of the invention to provide a portable seat where the support arms that support the seat portion are locked into position to provide a relatively stable seat portion for the user of the portable seat.

These are other objects of the invention will be apparent from the following detailed description of the invention.

SUMMARY OF THE INVENTION

A unipod seat with a support rod having a first end and a second end. The first end of the support rod having converging sidewalls and terminating in a point. A support bracket is rotatably mounted on the support rod. A support arm is pivotally mounted on each side of the support bracket. The support arms have a support position and a folded position. A means for locking the support arms in the support position and the locking means being mounted on the support bracket. A flexible material connected to the support arms. The flexible material forming a seat when the support arms are in the support position.

DETAILED DESCRIPTION OF THE PREFERRED EMBODIMENT

Figure 1:
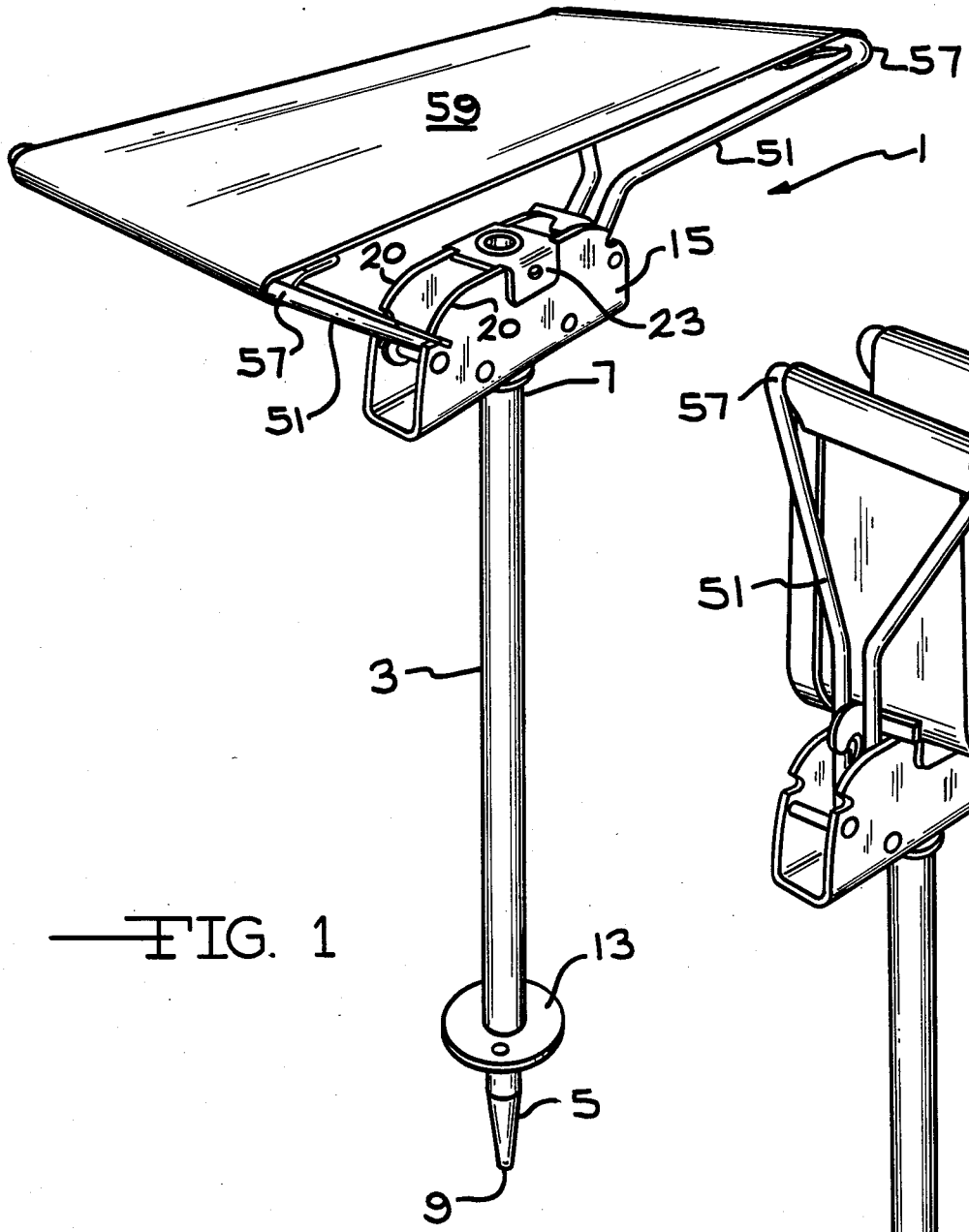
FIG. 1 is a perspective view of the unipod seat of the present invention.

The invention is directed to an improved unipod seat that is lightweight and easy to use. More particularly, the invention is directed to a locking means that can be utilized to maintain the support arms that hold the flexible seat material in a desired position. The features of the invention will be more fully understood by referring to the attached drawings in connection with the following description.

The unipod seat 1 has a hollow support rod 3 having a first end 5 and a second end 7. The first end of the support rod has converging side walls and terminates in a point 9. Positioned on the support rod 3 adjacent the first end 5 is a washer 13. The washer is positioned so that it extends from the support rod 3 in a direction that is substantially perpendicular to the longitudinal axis of the support rod. The washer is held in place by detents (not shown) positioned on the surface of the support rod. However, it should be understood that other suitable means can be utilized to properly position the washer 13. The washer 13 has a diameter that is usually at least twice the diameter of the support rod 3.

Positioned on the second end 7 or the support rod 3 is a support bracket 15. The support bracket 15 is substantially U-shaped and has a base 17 and opposed substantially parallel sides 19 that extend from each side of the base 17. Each end of the sides 19 has a radiused or curved section 20. An aperture 21 extends through substantially the center of the base 17. A clip 23 extends between the ends of the sides 19 that is spaced apart from the base 17. The clip 23 is positioned in notches 25 located in the sides 19 of the support bracket 15. The clip 23 is substantially U-shaped having a base section 27 and opposed substantially parallel legs 29 that extend from each side of the base section 27. The base section 27 is constructed to fit into the notches 25 located on the sides 19 of the support bracket 15. A portion of the base section 27 extends along the sides 19 on each side of the notches 25 to assist in locating the clip 23 in the proper location. The legs 29 of the clip 23 extend along the outside portion of the sides 19 of the support bracket 15 and also assist in locating the clip 27 in the proper location on the support bracket 15. The legs 29 are usually secured to the sides 19 to help to secure the clip 23 on the support bracket 15. A passageway 31 extends through substantially the center of the base section 27 of the clip 23 and the passageway 31 is disposed to be substantially in alignment with the aperture 21 that passes through the base 17 of the support bracket 15.

Figure 4:
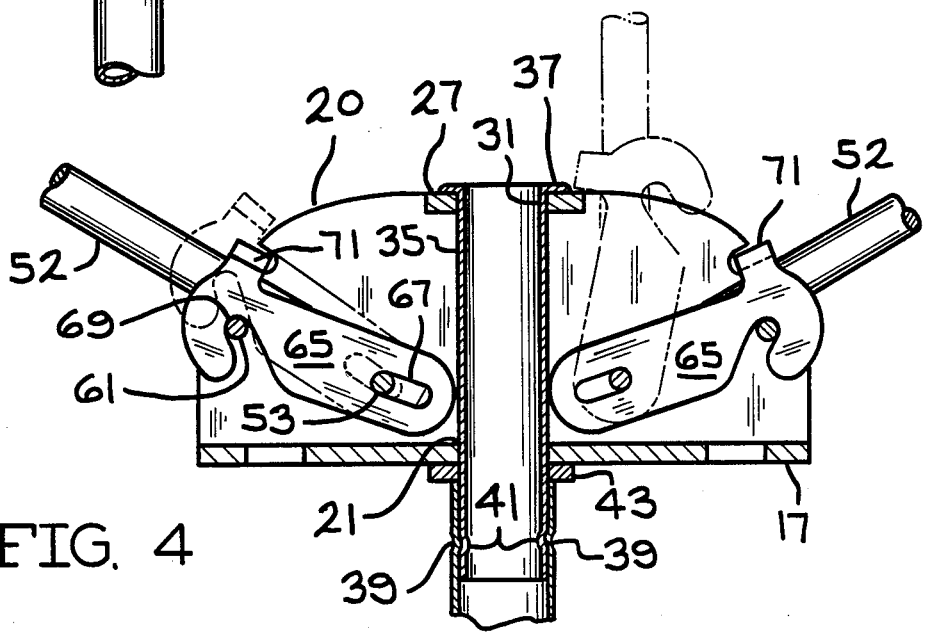
FIG. 4 is a cross-sectional view of a portion of the seat of the present invention.

The support bracket 15 is rotatably secured to the second end 7 of the support rod 3 by a section of tubing 35. The section of tubing 35 extends through the passageway 31 in the clip 23 and through the aperture 21 in the base 17 of the support bracket 15 and extends into the second end 7 of the support rod 3. The diameter of the section of tubing 35 is slightly smaller than the diameter of the passageway 31 and aperture 21 so that the support bracket 15 can rotate around the section of the tubing. The end of the section of tubing 35 that is adjacent the clip 23 contains a flared portion 37 and the flared portion has a diameter that is larger than the diameter of the passageway 31. The section of tubing 35 is secured to the support rod 3 by a plurality of indentations 39 placed on the surface of the support rod 3 that form corresponding indentations 41 in the section of tubing 35 and prevent the section of tubing from being removed from the support rod 3. The flared portion 37 acts to retain the support bracket 15 on the section of tubing 35. A washer 43 can be positioned at the second end 7 of the support rod 3 to provide additional support for the support bracket 15. The opening 45 in the washer 43 is designed to have a diameter that is slightly larger than the diameter of the section of tubing 35 but smaller than the diameter of the support rod 3. In this manner the washer 43 provides additional support for the base 17 of the support bracket 15 as shown in FIG. 4.

Pivotally connected to the support bracket 15 are a pair of support arms 51. The support arms are positioned on each side of the aperture 21 that extends through the base 17 of the support bracket 15. The support arms 51 are pivotally connected to the support bracket 15 by pins 53 that extend through the sides 19 and through one end of the support arms 51 to pivotally secure the support arms 51 to the support bracket 15. The support arms 51 extend from the support bracket 15 to form an attachment section 57 that is spaced apart from the support bracket 15. A flexible material 59 is connected to and extends between these attachment sections 57 of the support arms 51.

The support arms 51 are formed from a continuous section of rod. The ends 52 of the rod are secured to the support bracket by pins 53 and the ends are disposed in substantially parallel spaced apart relationship. The rod that forms the support arms diverge as they extend from the support bracket 15. At the end of the diverging section of the rod is the attachment section 57. The attachment sections 57 of the support arms 51 are disposed to be in substantially parallel opposed relationship.

A bar 61 extends between the sides 19 of the support bracket 15 on each end of the support bracket. The bar 61 provides a support to maintain the support arms 51 in the proper position to form the flexible material 59 into a seat. A groove 63 is positioned in each side 19 of the support bracket 15 adjacent the bar 61. A locking member 65 having an elongated aperture 67 is positioned on each side of the support bracket 15 between the ends 52 of the rods that form the support arms 51, with the pins 53 extending through the elongated aperture 67 in the locking member. The length of the elongated aperture 67 is at least twice the diameter of the pins 53. Accordingly, the locking member 65 is slideably and pivotally positioned on the pins 53. The locking member 65 has a hook portion 69 that is disposed so that it can engage and be secured to the bar 61. The locking member 65 has a flange 71 that extends in a substantially perpendicular direction from the locking member. The flange 71 is positioned to rest upon the upper edge of the sides 19 of the support bracket 15 and at least one of the ends 52 of the rod that forms the support arms 51. Although the flange 71 is shown extending from only one side of the locking member 65, the flange can extend from both sides of the locking member. The flanges 71 are disposed so that they can engage the groove 63 positioned in the sides 19 of the support bracket 15. The hook portion 69 is located on one side of the locking member 65 and the flange 71 is located on the opposite side. The hook portion 69 extends from one side of the support arms 51 and the flange 71 is located on the opposite side of the support arms. The locking members 65 can be secured to the support arms 51 so that locking members move with the support arms when the support arms are moved.

Figure 2:
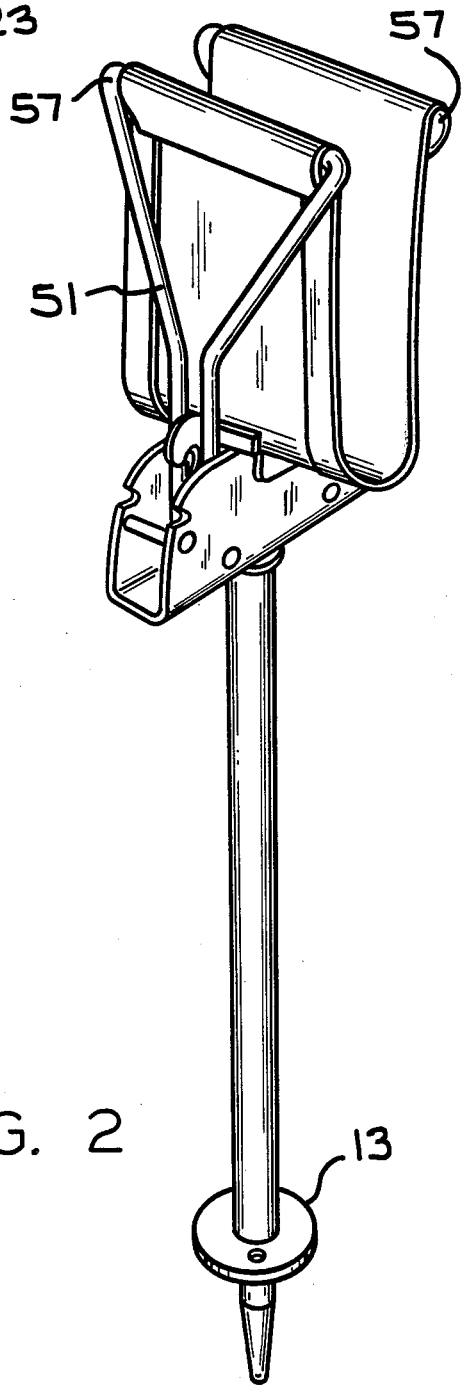
FIG. 2 is a perspective view of the invention.
Figure 3:
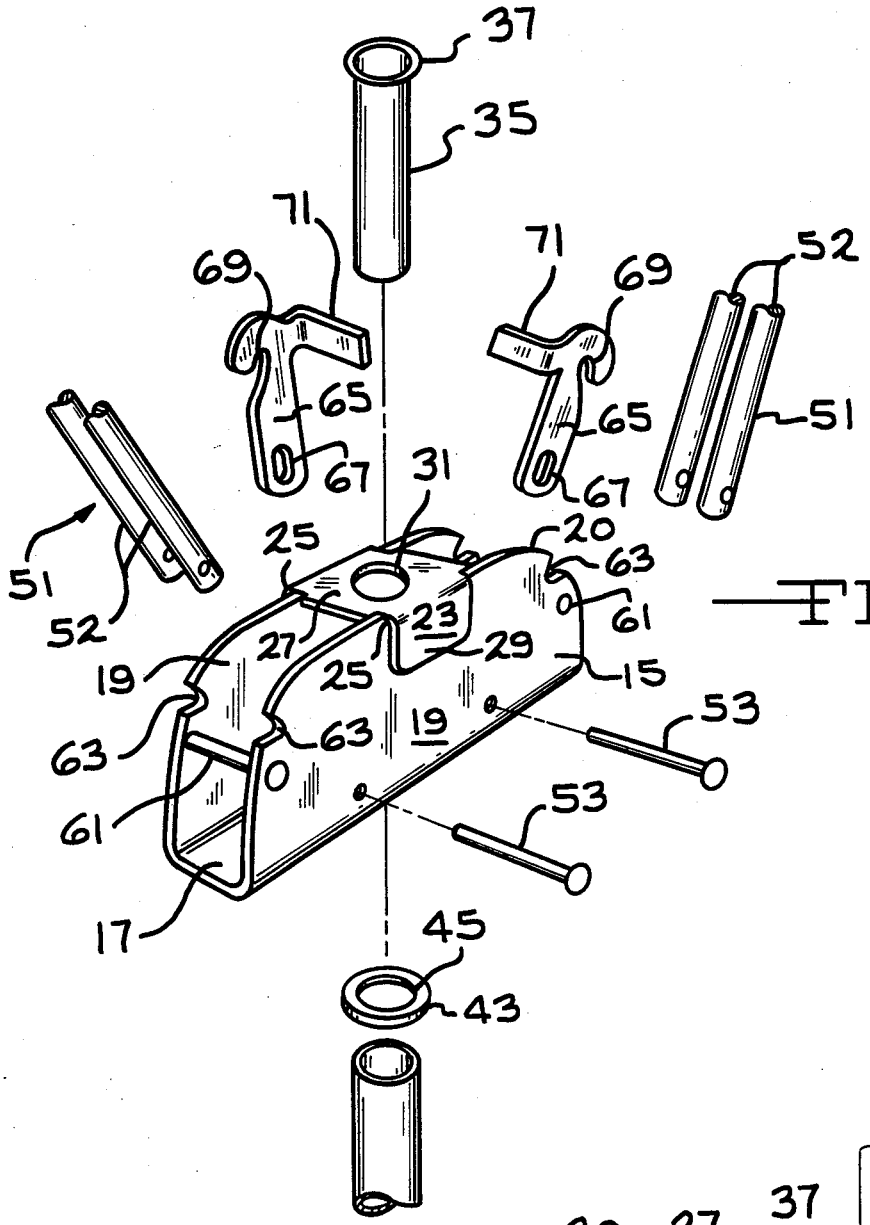
FIG. 3 is an exploded perspective view of a portion of the unipod seat.

In operation the unipod seat 1 is normally carried as shown in FIG. 2. In this figure, the support arms 51 are positioned so that they extend from the support bracket 15 in a direction that is substantially parallel to the longitudinal axis of the support rod 3. The attachment sections 57 of the support arms 51 form a handle by which the unipod seat may be carried. When it is desired to use the unipod seat the point 9 on the first end 5 of the support rod 3 is pushed at least partially into the ground. The washer 13 acts as a stop to prevent the first end 5 of the support rod 3 from being advanced too far into the ground. This prevents the unipod seat from being positioned into the ground so far that it becomes stuck or from having the first end 5 so secured into the ground that a user of the seat can bend the support rod 3 by leaning to the side. In most applications it is preferable for the point 9 to extend only a short distance below the surface to keep the first end 5 of the support rod 3 from moving.

Once the point 9 has been properly positioned on the ground, the support arms 51 are moved pivotally on pins 53 so that the attachment sections 57 are advanced in a direction away from one another. This causes the flexible material 59 to be stretched between the attachment section 57 and to form a seat for the user of the unipod seat 1. The locking members 65 usually pivot on the pins 53 and advance with the support arms as the support arms 51 are moved away from one another. Once the locking member 65 moves onto the curved section 20 of the sides 19, the force of gravity keeps the flange 71 of the locking member 65 resting against the support arms 51. As the locking member 65 is advanced, the flange 71 advances along the outer periphery of the sides 19. When the support arms 51 contact the bars 61 further movement of the attachment sections 57 in a direction away from one another is prevented. The locking member 65 is also disposed to engage the bar 61. The hook portion 69 of the locking member 65 is positioned immediately above the bar 61 when the flange 71 is positioned on the outer periphery of the sides 19 of the support bracket 15. The hook portion 69 engages the bar 61 as the flange 71 moves into groove 63 positioned on the outer periphery of the sides 19. When the flange 71 is in alignment with the groove 63, the flange moves into the groove as the elongated aperture 67 in the locking member 65 allows the locking member to move towards the base 17 of the support bracket 15. In this manner the hook portion 69 engages the bar 61 to retain the locking member 65 in this position. The flange 71 is also positioned in the groove 63 to further maintain the locking member in this locked position. The flange 71 rests against the side of the support arms 51 that is spaced apart from the bar 61 and the flange acts to hold the support arms 51 against the bar 61. When the support arms are in contact with the bar 61 the flexible material 59 is held in a relatively taunt position to form a seat for the user of the unipod seat. To release the locking member 65 so that the unipod seat can be folded, the locking member is moved in a direction away from the base 17 of the support bracket 15. This allows the hook portion 69 to be disengaged from the bar 61. At the same time the flange 71 is also disenaged from the groove 63 and this fully releases the locking member so that the support arms 51 are free to be moved in a direction away from the bar 61.

Usually the effect of gravity is sufficient to cause the locking member to move towards the base 17 when the flange 71 is in alignment with the groove 63. However, in some applications it may be necessary to supply a small additional force to more the locking member towards the base 17. Also, only a small force is usually required to disengage the flange 71 of the locking member 65 from the groove 63. Thus, it is very simple and easy for a person to use the unipod seat.

Figure 5:
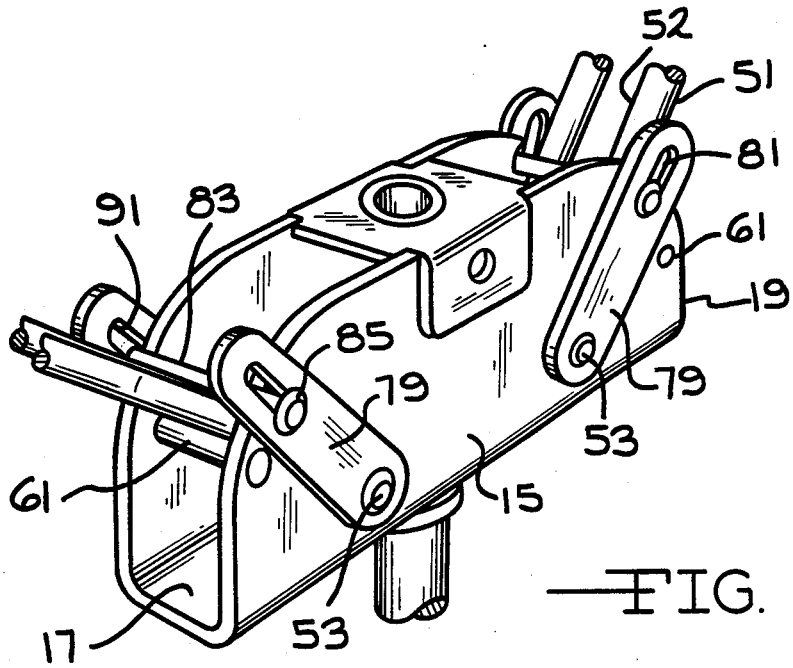
FIG. 5 is a partial perspective view showing another embodiment of the invention.
Figure 6:
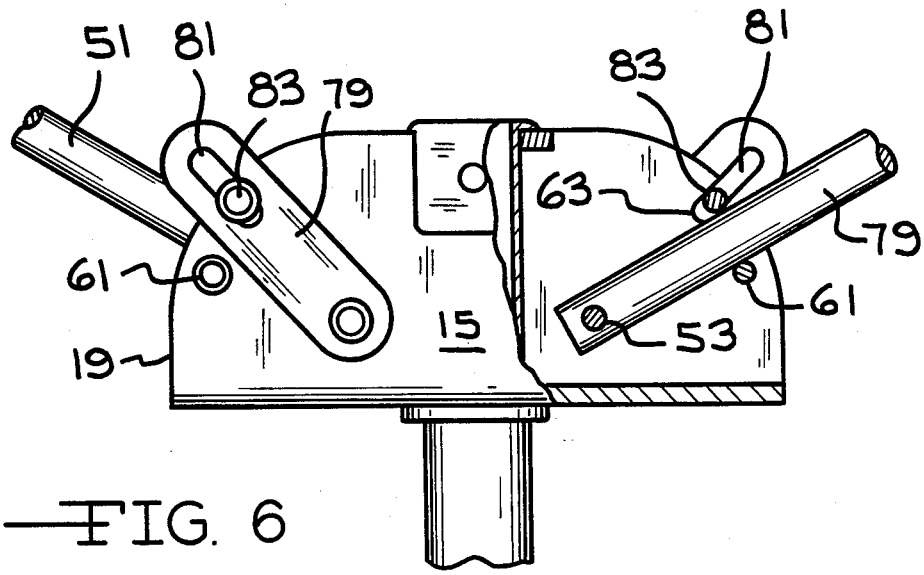
FIG. 6 is a partial cross-sectional view of the embodiment shown in FIG. 5.

FIGS. 5 and 6 show another embodiment of the unipod seat invention. The embodiment shown in FIGS. 5 and 6 is very similar to the unipod seat 1 previously described. However, this embodiment utilizes a different locking mechanism to maintain the support arms 51 in the desired position against bar 61. In this embodiment links 79 are pivotally connected to the pins 53 that are used to secure the support arms 51 to the support bracket 15. The links 79 are positioned so that they are on the outer portion of the sides 19 of the support bracket 15. In the end of the links 79 that is spaced apart from the pin 53 there is an elongated aperture 81. A locking pin 83 is positioned in the elongated apertures 81 and extends across the sides 19 of the support bracket 15. The locking pin 83 has a enlarged head 85 on each end and the enlarged head has a diameter that is greater than the width of the elongated aperture 81. Accordingly, the enlarged heads 85 prevent the locking pin 83 from becoming disengaged from the elongated apertures 81 in the links 79. The elongated aperture 81 is positioned so that the locking pin 83 will be in engagement with the outer periphery of the sides 19 of the support bracket 15. When the ends 52 of the support arms 51 are moved into engagement with the bar 61, the links 79 can be pivoted to follow the movement of the support arms 51. When the locking pin 83 is in alignment with the grooves 63 located in the sides 19, the locking pins 83 can be moved into the groove 63 due to the length of the elongated aperture 81. When the locking pins 83 are positioned in the grooves 63, the links 79 will be prevented from moving. Since the locking pin 83 is also in contact with the support arms 51, the locking pins 83 will act to hold the support arms 51 against the bar 61. This maintains the support arms 51 in a position where the flexible material (not shown) can form a suitable seat for a user of the unipod seat of this invention.

To release the support arms 51 so that the unipod seat can be folded it is necessary to advance the locking pins 83 in the elongated aperture 81.in a direction away from the pins 53. This moves the locking pins from the groove 63 in the sides 19 and allows the locking pins 83 and links 79 to be advanced along the outer periphery of the sides 19 in a direction away from the bar 61. At the same time this releases the support arms 51 so they can be advanced in a direction away from the bar 61 so the unipod seat can be folded up for easier carrying or storage.

The above detailed description of the invention is given only for the sake of explanation. Various modifications and substitutions can be made without departing from the scope of the following claims.

What I claim is:

1. A unipod seat comprising:

a support rod having a first end and a second end, said first end having converging sidewalls and terminating in a point;

a support bracket mounted on said support rod, said support bracket being substantially U-shaped having a base and opposed substantially parallel sides that extend from each side of said base, an aperture extends through substantially the center of said base;

a support arm pivotally mounted on each side of said support bracket, said support arms having a support position and a folded position;

a bar extending between said sides of said support bracket at each end of said support bracket, said support arms being in contact with said bars when said support arms are in said support position;

a means for locking said support arm in said support position, said locking means being mounted on said support bracket, said locking means being positioned on each side of said support bracket and said locking means engaging said bar on said same side of said support bracket to retain said support arms in contact with said bars to retain said support arms in said support position; and, a flexible material connected to said support arms, said material forming a seat when said support arms are in said support position.

2. The seat of claim 1, wherein a tube is positioned in said second end of said support rod, said tube extending into and being secured to said support rod, a portion of said tube extending from said support rod.

3. The seat of claim 1, wherein a clip extends between and is secured to the ends of said sides of said support bracket that is spaced apart from said base, a passageway extending through substantially the center of said clip, said passageway being substantially in alignment with said aperture in said base of said support bracket.

4. A unipod seat comprising:

a support rod having a first end and a second end, said first end having converging sidewalls and terminating in a point;

a tube positioned in said second end of said support rod, said tube extending into and being secured to said support rod, a portion of said tube extending from said support rod;

a support bracket rotatably mounted on said support rod, said support bracket being substantially U-shaped having a base and opposed substantially parallel sides that extend from each side of said base, an aperture extending through substantially the center of said base;

a clip extending between and secured to the ends of said sides of said support bracket that is spaced apart from said base, a passageway extending through substantially the center of said clip, said passageway being substantially in alignment with said aperture in said base of said support bracket;

a support arm pivotally mounted on each side of said support bracket, said support arms having a support position and a folded position;

a means for locking said support arm in said support position, said locking means being mounted on said support bracket; and, a flexible material connected to said support arms, said material forming a seat when said support arms are in said support position.

5. The seat of claim 4, wherein said support bracket is rotatably mounted on said end of said tube that extends from said support rod, said tube extending through said aperture in said base and said passageway in said clip, the end of said tube that is spaced apart from said support rod being flared to retain said support bracket on said tube.

6. A unipod seat comprising:

a support rod having a first end and a second end, said first end having converging sidewalls and terminating in a point;

a tube positioned in said second end of said support rod, said tube extending into and being secured to said support rod, a portion of said tube extending from said support rod;

a support bracket rotatably mounted on said support rod, said support bracket being substantially U-shaped having a base and opposed substantially parallel sides that extend from each side of said base, an aperture extending through substantially the center of said base;

a support arm pivotally mounted on each side of said support bracket, said support arms having a support position and a folded position;

a bar extending between said sides of said support bracket at each end of said support bracket, said support arms being in contact with said bars when said support arms are in said support position;

a means for locking said support arm in said support position, said locking means being mounted on said support bracket, said locking means being positioned on each side of said support bracket and engaging said bar to retain said support arms in contact with said bar to retain said support arms in said support position, said locking means being a member pivotally and slideably mounted on said support bracket, said locking member having a hook portion and a flange, said hook portion extending from one side of said support arms and disposed to engage said bar that extends between said sides of said support bracket, said flange extends across at least a portion of the side of said support arms that is opposite to the side where said hook portion extends and said flange extending across the outer periphery of one of said sides of said support bracket whereby said flange holds said support arms against said bar when said hook portion engages said bar to retain said support arms in said support position; and a flexible material connected to said support arms, said material forming a seat when said support arms are in said support position.

7. The seat of claim 6, wherein a groove is positioned in at least one of said sides of said support bracket adjacent each of said bars, said grooves being disposed to receive said flange on said locking member, said locking member sliding towards said base of said support bracket to have said flange engage said groove and said hook portion to engage said bar to lock said support arms in said support position.

8. A unipod seat comprising:

a support rod having a first end and a second end, said first end having converging sidewalls and terminating in a point;

a tube positioned in said second end of said support rod, said tube extending into and being secured to said support rod, a portion of said tube extending from said support rod;

a support bracket rotatably mounted on said support rod, said support bracket being substantially U-shaped having a base and opposed substantially parallel sides that extend from each side of said base, an aperture extending through substantially the center of said base;

a support arm pivotally mounted on each side of said support bracket, said support arms having a support position and a folded position;

a bar extending between said sides of said support bracket at each end of said support bracket, said support arms being in contact with said bars when said support arms are in said support position;

a means for locking said support arm in said support position, said locking means being mounted on said support bracket, said locking means being two members pivotally positioned on each end of said support bracket, said members extending beyond said sides of said support bracket and having an elongated aperture in the end of said members that extend beyond said sides of said support bracket, a locking pin slideably positioned in said elongated apertures and extending between said members, said locking pin extending across the outer periphery of said sides of said support bracket, said locking pin being positioned on the opposite side of said support arms from said bar; and, a flexible material connected to said support arms, said material forming a seat when said support arms are in said support position.

9. The seat of claim 8, wherein a groove is positioned on each side of said support bracket adjacent said bar, said grooves being disposed to receive said locking pin, said locking pin being slideably moved in said elongated aperture in said locking members to engage said grooves when said support arms are in engagement with said bars to secure said support arms in said support position.

10. A unipod seat comprising:

a support rod having a first end and a second end, said first end having converging sidewalls and terminating in a point;

a support bracket rotatably mounted on said support rod, said support bracket is substantially U-shaped having a base and opposed substantially parallel sides that extend from each side of said base, an aperture extending through substantially the center of said base;

a support arm pivotally mounted on each side of said support bracket, said support arms having a support position and a folded position;

a bar extending between said sides of said support bracket at each end of said support bracket, said support arms being in contact with said bars when said support arms are in said support position;

a means for locking said support arms in said support position, said locking means being a member pivotally and slideably mounted on said support bracket, said locking member having a hook portion and a flange, said hook portion extending from one side of said support arms and disposed to engage said bar that extends between said sides of said support bracket, said flange extends across at least a portion of the side of said support arms that is opposite to the side where said hook portion extends and said flange extending across the outer periphery of one of said sides of said support bracket whereby said flange holds said support arms against said bar when said hook portion engages said bar to retain said support arms in said support position;

a groove is positioned in at least one of said sides of said support bracket adjacent each of said bars, said grooves being disposed to receive said flange on said locking member, said locking member sliding towards said base of said support bracket to have said flange engage said groove and said hook portion to engage said bar to lock said support arms in said support position; and, a flexible material connected to said support arms, said material forming a seat when said support arms are in said support position.

* * * * *